United States Patent [19]

Scarano

[11] Patent Number: 4,470,200

[45] Date of Patent: Sep. 11, 1984

[54] BLOCK LEVELING DEVICE

[75] Inventor: Gary J. Scarano, Matawan, N.J.

[73] Assignee: Auto Leads, Inc., Matawan, N.J.

[21] Appl. No.: 458,202

[22] Filed: Jan. 17, 1983

[51] Int. Cl.[3] ..... E04G 21/18

[52] U.S. Cl. ..... 33/408; 33/410

[58] Field of Search ..... 33/404–410

[56] References Cited

U.S. PATENT DOCUMENTS

| | | | |
|---|---|---|---|
| 614,577 | 11/1898 | Reineking | 33/410 |
| 2,919,489 | 1/1960 | Espinosa | 33/410 |
| 3,299,515 | 1/1967 | Lessard | 33/408 |
| 3,751,810 | 8/1973 | Valva | 33/410 |

FOREIGN PATENT DOCUMENTS

| | | | |
|---|---|---|---|
| 104711 | 8/1938 | Australia | 33/404 |
| 829788 | 1/1952 | Fed. Rep. of Germany | 33/404 |

*Primary Examiner*—Harry N. Haroian

*Attorney, Agent, or Firm*—Lerner, David, Littenberg, Krumholz & Mentlik

[57] ABSTRACT

Apparatus and method for leveling masonry blocks are disclosed by which at least two courses of blocks can be laid and leveled without having to reposition the apparatus and without having to construct lead corners.

10 Claims, 9 Drawing Figures

BLOCK LEVELING DEVICE

FIELD OF THE INVENTION

The present invention relates to block leveling devices and methods, and, more particularly, to such devices and methods which are especially adapted to facilitate the construction of walls made from masonry blocks. As used herein, the term "masonry blocks" denotes cement blocks, cinder blocks, bricks and all other equivalent types of construction materials.

BACKGROUND OF THE INVENTION

When constructing a building wall made from masonry blocks, masons normally erect guide blockwork at the corners of the wall. The guide blockwork at each corner is typically referred to as a lead corner. From these lead corners, a guide line is stretched therebetween to facilitate the laying and leveling of the remaining blocks.

One primitive method of trigging the guide line is to drive a nail or spike into the mortar between the blocks of opposite lead corners and then tightly stretch the guide line between the nails or spikes. If the guide line is stretched too tightly, the mortar can crack and cause the guide line to sag, thereby inhibiting the laying of a straight and level wall.

In an effort to improve upon the primitive trigging method described above, numerous more sophisticated techniques have been developed to trig the guide line. These prior techniques are not completely satisfactory because they utilize devices which require either (i) construction of lead corners or a substantial portion of a course (see, for instance, U.S. Pat. Nos. 402,360; 441,492; 614,577; 1,092,058; 2,685,741; 2,728,142; 2,761,214; 2,788,579; 2,833,043 and 3,397,458) or (ii) repositioning in order to lay mutiple courses (see, for instance, U.S. Pat. Nos. 995,714; 2,659,973; 2,665,487 and 3,148,453). The construction of lead corners or a substantial portion of a course is time consuming and therefore undesirable. It is also time consuming and therefore undesirable to reposition the trigging devices after each course has been laid.

SUMMARY OF THE PRESENT INVENTION

The problems and disadvantages of the prior art described above are overcome in accordance with the present invention by providing a masonry block leveling device with a mounting mechanism designed to mount the device on a single block. The block leveling device further includes a first guiding mechanism adapted to guide a guide line in a horizontal direction along an upper edge of the block to facilitate the leveling of a first course of blocks. A second guiding mechanism provided on the block leveling device is designed to guide a guide line in a horizontal direction at a first preselected elevation above the upper edge of the block to facilitate the leveling of a second course of blocks above the first course. Thus, the block leveling device facilitates the leveling of at least two courses without having to move the device and without having to construct lead corners, thereby reducing the time required to construct a plurality of courses.

In one embodiment, which is especially adapted for use in connection with cement blocks and cinder blocks, the mounting mechanism includes a base which traverses an upper surface of the block. A first clamping member is rigidly attached to the base so that it extends downwardly therefrom adjacent to an outer side of the block. A second clamping member, which is movably attached to the base, extends downwardly from the base adjacent to an inner side of the block. The two clamping members cooperate with the base to releaseably clamp the block leveling device to the upper surface of the block. Because cement blocks and cinder blocks come in two standard heights, this embodiment may also be provided with a third guiding mechanism designed to guide a guide line in a horizontal direction at a second preselected elevation above the upper edge of the block to facilitate the leveling of the second course. By selecting the first preselected elevation for blocks having a first standard height and the second preselected elevation for blocks having a second standard height, the block leveling device can be used on blocks of either standard height. In order to inhibit sagging of the guide line, the block leveling device may be equipped so as to tension the guide line.

In another embodiment, which is especially adapted for use in connection with bricks, the mounting mechanism includes an adjustable base which traverses an upper surface of a block. A first clamping member is rigidly attached to one end of the base so that it extends downwardly therefrom adjacent to an outer side of the block. A second clamping member is rigidly attached to an opposite end of the base so that it extends downwardly therefrom adjacent to an inner side of the block. The second clamping member is dimensioned so as to fit in a relatively small air space between the inner side of the block and an adjacent structure. Because bricks come in three common heights, this embodiment can be provided with a third guiding mechanism designed to guide a guide line in a horizontal direction at a second preselected elevation above the upper edge of the block and a fourth guiding mechanism designed to guide a guide line in a horizontal direction at a third preselected elevation above the upper edge of the block. By selecting each elevation such that it corresponds to a common brick height, this embodiment can be used on bricks of the three most common heights.

Both of the embodiments described above are especially suited for use in the performance of a new and improved method of laying multiple courses of blocks which involves laying and leveling a block at one end of a first course and laying and leveling another block at an opposite end of the first course. After mounting a first block leveling device, which includes first and second guiding mechansims, on one of the end blocks and mounting a second block leveling device, which also includes first and second guiding mechanisms, on the other end block, a guide line is attached to the block leveling devices such that the first guiding mechanisms cooperate to guide the guide line in a generally horizontal direction along aligned upper edges of the end blocks. The remaining blocks of the first course are then laid between the end blocks using the guide line to facilitate their leveling. The same or another guide line can then be attached to the second guiding mechanisms such that it is guided in a horizontal direction at a preselected elevation above the upper edges of the end blocks to facilitate the leveling of at least some of the blocks which constitute a second course above the first course.

BRIEF DESCRIPTION OF THE DRAWINGS

For a better understanding of the present invention, reference is made to the following detailed description of two exemplary embodiments considered in conjunction with the accompanying drawings, in which.

DESCRIPTION OF THE EXEMPLARY EMBODIMENTS

Figure 1:
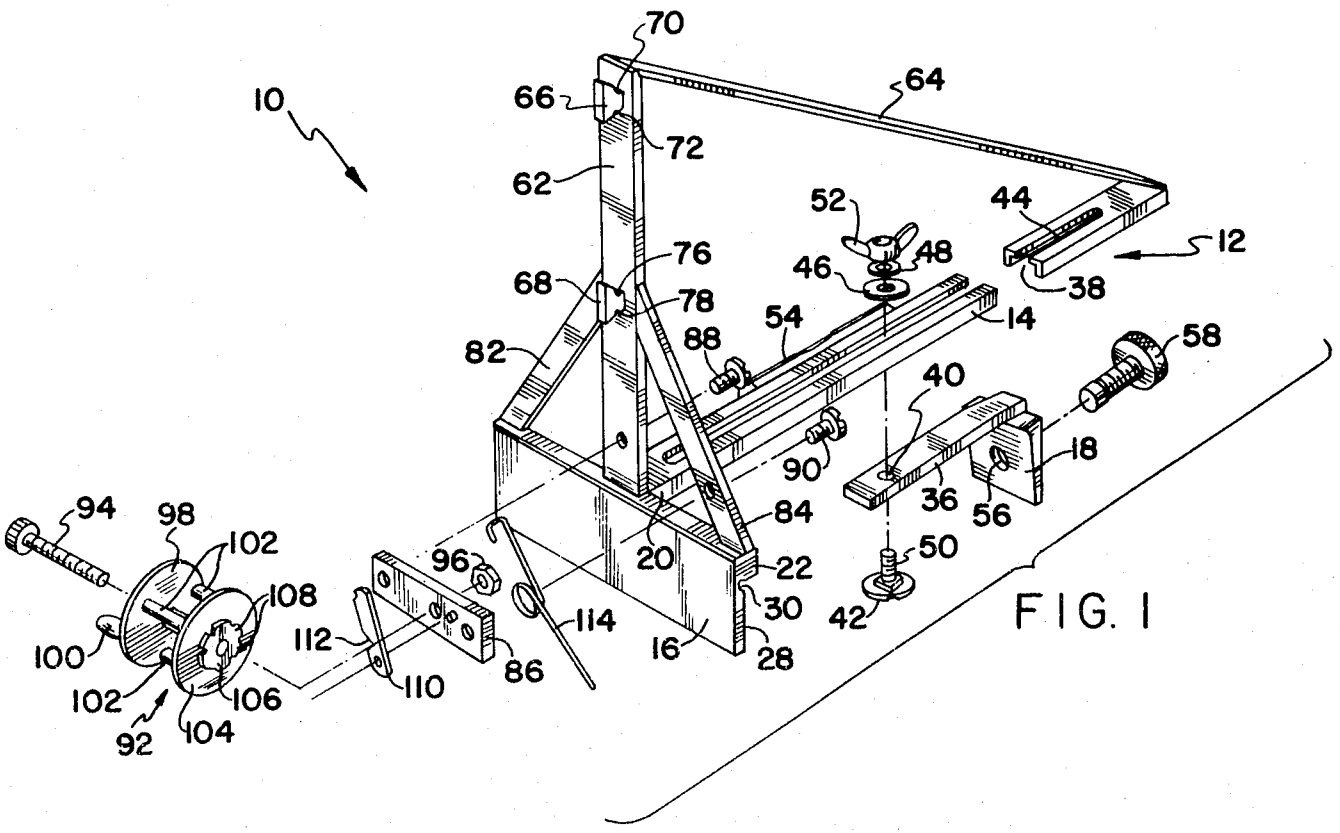
FIG. 1 is an exploded view of a block leveling device constructed in accordance with one exemplary embodiment of the present invention.
Figure 2:
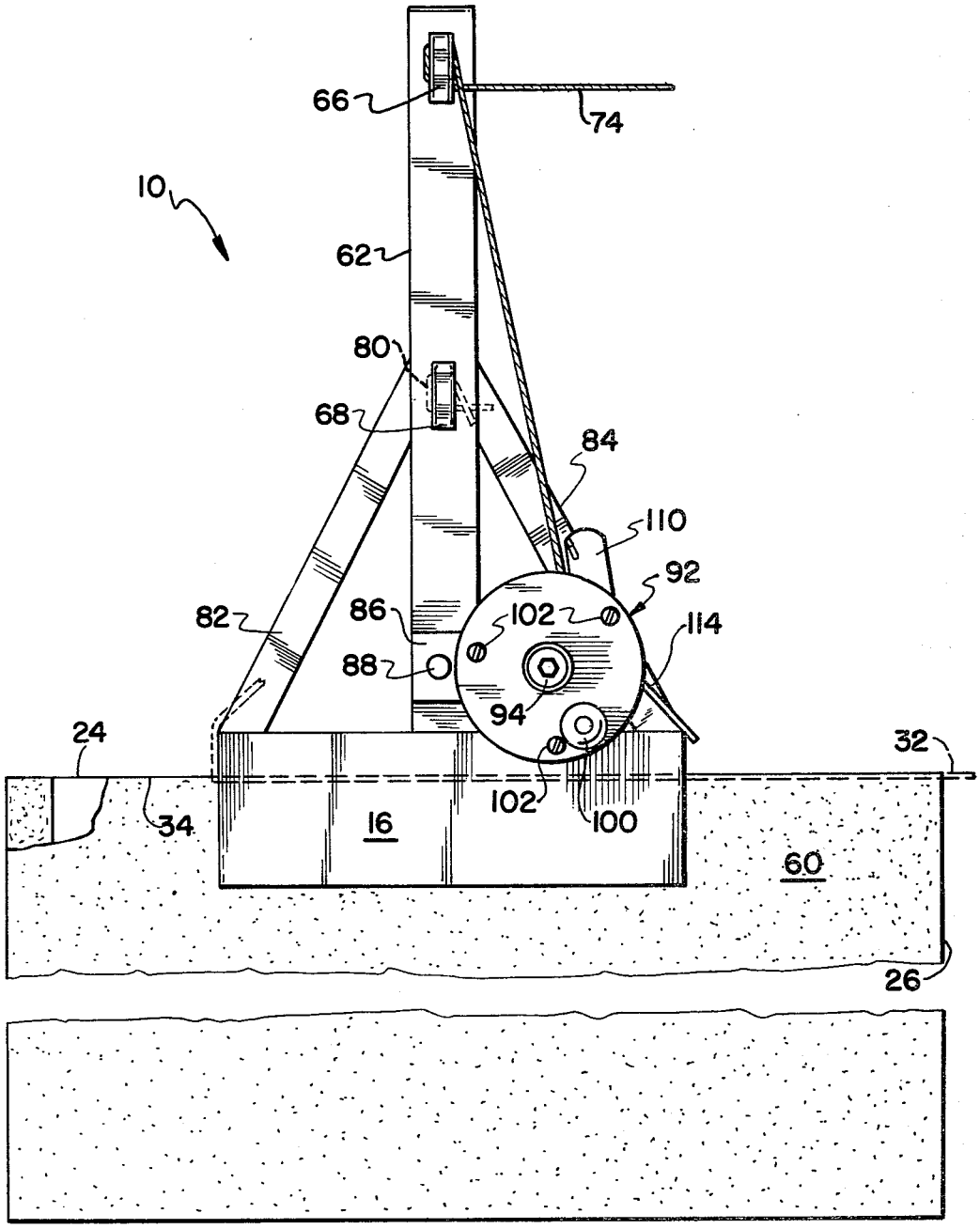
FIG. 2 is a side elevational view of the block leveling device of FIG. 1 in operation.

Referring to FIGS. 1 and 2, there is shown a block leveling device 10 which includes a clamp-type mounting assembly 12. The mounting assembly 12 includes a base 14, a fixed clamping member 16 and a movable clamping member 18.

The fixed clamping member 16 is rigidly attached to one end 20 of the base 14, which has an inverted U shape in transverse cross section, so as to extend downwardly therefrom at a generally right angle thereto. A lip 22, which is designed to engage an upper surface 24 of a cement block 26 (see FIG. 2), extends inwardly from an inner surface 28 of the fixed clamping member 16 along the entire length thereof. An elongated groove 30 is formed in the lip 22 and the inner surface 28 of the fixed clamping member 16. The groove 30 is sized and shaped so as to receive a guide line 32, which is shown in phantom in FIG. 2, and guide it in a generally horizontal direction along an upper edge 34 of the block 26 (see FIG. 2).

The movable clamping member 18 includes a slide 36 which is slidably received in a downwardly opening channel 38 formed in the base 14. An opening 40 is provided in the slide 36 so as to receive a bolt 42, which extends upwardly through a slot 44 in the base 14. A conventional washer 46 and a lock washer 48 are positioned over a threaded portion 50 of the bolt 42, which threadedly receives a wing nut 52. When the wing nut 52 is loosened, the slide 36 can be slid along the channel 38 in the base 14 to accommodate blocks having various different widths.

A level 54 (see FIG. 1) is attached to the base 14 so that the base 14 can be arranged in a horizontal plane after the block leveling device 10 has been properly located on the block 26 (see FIG. 2). A threaded opening 56 is provided in the movable clamping member 18 so as to threadedly receive a lock bolt 58, which, when tightened, engages an inner side of the block 26 to thereby clamp the inner surface 28 of the fixed clamping member 16 against an outer side 60 of the block 26 (see FIG. 2).

An upright 62 is rigidly attached to the fixed clamping member 16 so as to extend upwardly therefrom at substantially a right angle to the base 14. The right angle formed between the base 14 and the upright 62 is maintained by a brace 64. The upright 62 includes an upper lug 66 and a lower lug 68, both of which extend outwardly from the upright 62. The upper lug 66 is provided with an upper slot 70 and a lower slot 72, both of which are sized and shaped so as to receive a guide line 74 which loops around the lug 66 (see FIG. 2). Similarly, the lower lug 68 is provided with an upper slot 76 and a lower slot 78, both of which are sized and shaped so as to receive a guide line 80, which is shown in phantom in FIG. 2. The lower slot 72 in the upper lug 66 is arranged so as to guide the guide line 74 in a generally horizontal direction at a first preselected elevation, such as about eight inches, above the upper edge 34 of the block 26 (see FIG. 2) to facilitate the leveling of a second course of eight inch high blocks above the first course. The lower slot 78 in the lower lug 68 is arranged so as to guide the guide line 80 in a generally horizontal direction at a second preselected elevation, such as about four inches, above the upper edge 34 of a block 26 (see FIG. 2) to facilitate the leveling of a second course of four inch high blocks above the first course. Thus, the block leveling device 10 is adapted for use with four inch or eight inch high blocks, which are typically slightly less than four and eight inches high, respectively. Alternatively, the slots 72, 78 can be located such that the guide line 74 facilitates the leveling of a second course and the guide line 80 facilitates the leveling of a third course. The lugs 66, 68 also may function as tie-ups for the guide lines 32, 74, 80.

Support arms 82, 84 extend between the fixed clamping member 16 and the upright 62. A mounting plate 86 is mounted by screws 88, 90 to the upright 62 and the support arm 84, respectively. A reel 92 is rotatably mounted on the mounting plate 86 by a bolt 94 and a nut 96, the bolt 94 also functioning as a tie-up for the guide lines 32, 74, 80 to attach them to the reel 92. The reel 92 has an outer end 98, which is provided with a handle 100 and pins 102, and an inner end 104, which receives the pins 102 and carries a ratchet wheel 106 having teeth 108. A pawl 110 is pivotally attached to the mounting plate 86 by the screw 90. The pawl 110 has a notch 112 sized and shaped so as to engage the teeth 108 of the ratchet wheel 106. A spring 114 is pivotally mounted about the screw 90 between the support arm 84 and the mounting plate 86. The spring 114 urges the pawl 110 to pivot in a clockwise direction into a position in which the notch 112 engages one of the teeth 108 of the ratchet wheel 106 to prevent the reel 92 from rotating in a counterclockwise direction. The reel 92 can, however, be gripped by the handle 100 and rotated in a clockwise direction, so that the guide line 74, which is attached to the bolt 94, can be wound about the pins 102 of the reel 92 and thereby tensioned to inhibit it from sagging. The pawl 110 can be manually pivoted in a counterclockwise direction so as to disengage the notch 112 from the teeth 108 of the ratchet wheel 106, thereby permitting the release of the guide line 74.

The block leveling device 10 of FIGS. 1 and 2 is especially adapted for use in connection with cement blocks and cinder blocks. If, however, the block leveling device 10 were used in connection with bricks, the base 14, because of its length, would overhang the brickwork. On many construction jobs, the brickwork is separated from an adjacent building structure by an air space which can be as small as about one half inch. On such jobs, the overhanging portion of the base 14 would prevent the block leveling device 10 from being used to facilitate the laying of the brickwork.

Figure 3:
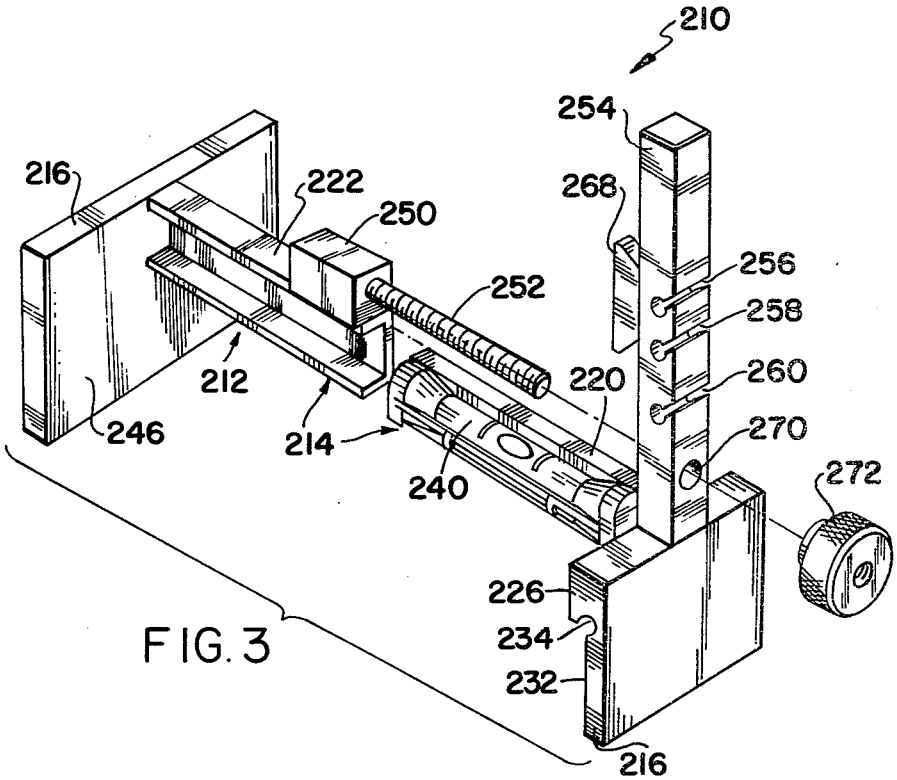
FIG. 3 is an exploded view of a block leveling device constructed in accordance with a second exemplary embodiment of the present invention.
Figure 4:
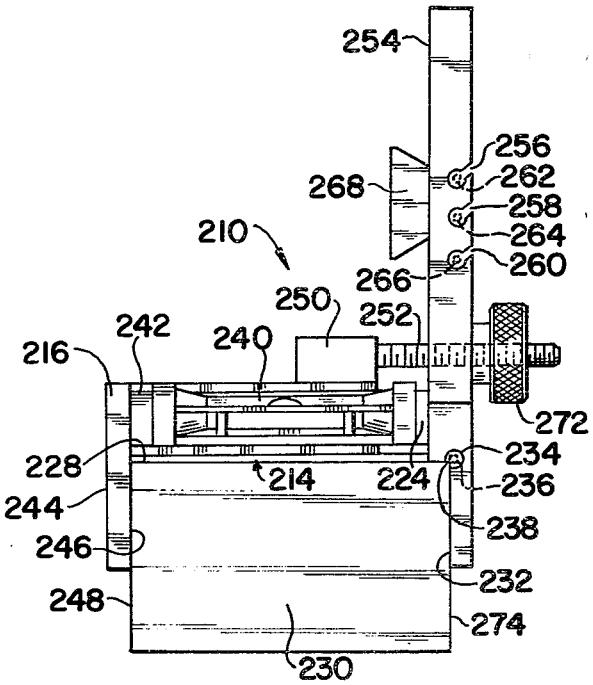
FIG. 4 is a front or rear elevational view of the block leveling device of FIG. 1 in operation.
Figures 5, 6, 7, 8, 9:
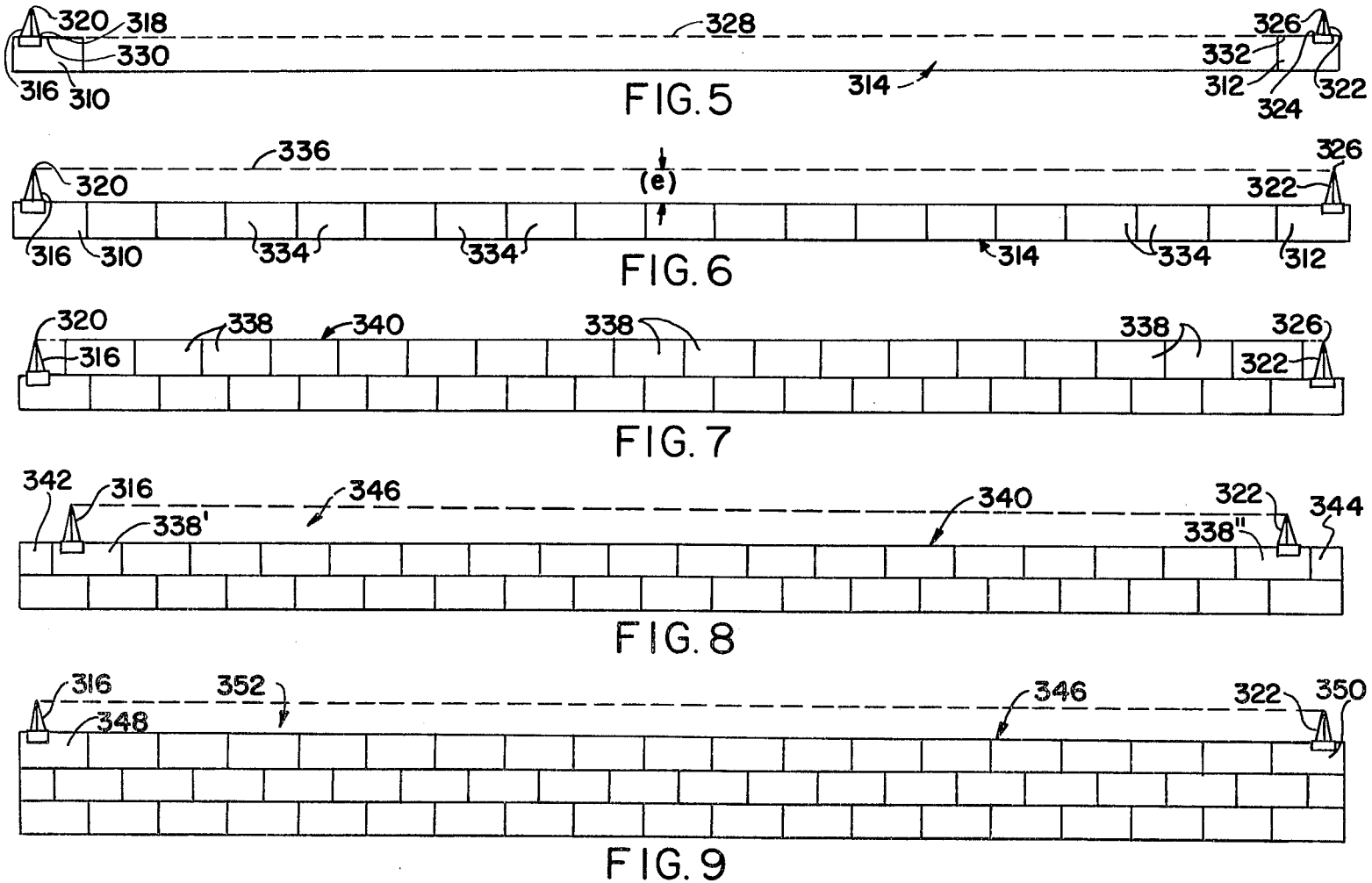
FIGS. 5–9 are schematic illustrations of various steps in a block laying method adapted to utilize the block leveling devices of FIGS. 1–4.

With reference now to FIGS. 3 and 4, there is shown a block leveling device 210 which is especially suited for use in connection with bricks. The block leveling device 210 includes a mounting assembly 212. The mounting assembly 212 includes a base 214, a clamping member 216 and a clamping member 218.

The base 214 includes a first base member 220, which has a rectangular shape in transverse cross section, and a second base member 222, which has a block C shape in transverse cross section. The cross-sectional shapes of the base members 220, 222 are selected so that the base member 220 is slidably received in the base member 222, whereby the length of the base 214 can be adjusted to accommodate bricks having various different widths.

The clamping member 216 is rigidly attached to one end 224 of the base member 220 so as to extend downwardly therefrom at a generally right angle thereto. A lip 226, which is designed to engage an upper surface 228 of a brick 230 (see FIG. 4), extends inwardly from an inner surface 232 of the clamping member 216 along the entire length thereof. An elongated groove 234 is formed in the lip 226 and the inner surface 232 of the clamping member 216. The groove 234 is sized and shaped so as to receive a guide line 236, which is shown in phantom in FIG. 4, and guide it in a generally horizontal direction along an upper edge 238 of the brick 230 (see FIG. 4). A level 240 is attached to the base member 220 so that the base 214 can be arranged in a horizontal plane after the block leveling device 210 has been properly located on the brick 230 (see FIG. 4).

The clamping member 218 is rigidly attached to one end 242 of the base member 222 so as to extend downwardly therefrom at a generally right angle thereto. The clamping member 218 has a flat outer surface 244 and a flat inner surface 246, the distance between the outer surface 244 and the inner surface 246 being such that the clamping member 218 can fit into a relatively small air space between an inner side 248 of the brick 230 (see FIG. 4) and an adjacent structure (not shown). A mounting block 250 is carried on the base member 222. A threaded rod 252 extends outwardly from the mounting block 250.

An upright 254 is rigidly attached to the clamping member 216 so as to extend upwardly therefrom at a substantially right angle to the base 214. The upright 254 includes an upper slot 256, a middle slot 258 and a lower slot 260. Each of the slots 256, 258, 260 is sized and shaped so as to receive guide lines 262, 264, 266, respectively, which are shown in phantom in FIG. 4. The upper slot 256 in the upright 254 is arranged so as to guide the guide line 262 in a generally horizontal direction at a first preselected elevation, such as about three and a quarter inches, above the upper edge 238 of the brick 230 (see FIG. 4) to facilitate the leveling of a second course of three and a quarter inch high bricks above the first course. The middle slot 258 in the upright 254 is arranged so as to guide the guide line 264 in a generally horizontal direction at a second preselected elevation, such as about two and three quarter inches, above the upper edge 238 of the brick 230 (see FIG. 4) to facilitate the leveling of a second course of two and three quarter inch high bricks above the first course. The lower slot 260 in the upright 254 is arranged so as to guide the guide line 266 in a generally horizontal direction at a third preselected elevation, such as about two inches, above the upper edge 238 of the brick 230 (see FIG. 4) to facilitate the leveling of a second course of two inch high bricks above the first course. Thus, the block leveling device 210 is adapted for use with bricks of the three most common heights (i.e., slightly less than three and a quarter inches, slightly less than two and three quarter inches and slightly less than two inches, respectively). Alternatively, the slots 256, 258, 260 can be located such that the guide line 262 facilitates the leveling of a second course, the guide line 264 facilitates the leveling of a third course and the guide line 266 facilitates the leveling of a fourth course.

A lug 268 extends inwardly from the upright 254. The lug 268 can be used to anchor the guide lines 236, 262, 264, 266. The upright 254 also includes a hole 270, which is sized and shaped so as to receive the threaded rod 252. A lock nut 272 is threadedly received on the portion of the rod 252 which extends outwardly from the upright 254. When the position of the base members 220, 222 has been adjusted to accommodate a brick having a particular width, the lock nut 272 can be threaded onto the rod 252 until the lock nut 272 engages the upright 254 to thereby clamp the inner surface 232 of the clamping member 216 against an outer side 274 of the brick 230 and the inner surface 246 of the clamping member 218 against the inner side 248 of the brick 230 (see FIG. 4).

Both the block leveling device 10 and the block leveling device 210 can be used in the performance of the block laying method illustrated in FIGS. 5–9. Referring now to FIGS. 5–9, blocks 310, 312 are laid and leveled at opposite ends of a first course 314 (see FIG. 5). A first block leveling device 316, which includes a first guiding mechanism 318 and a second guiding mechanism 320, is mounted on the block 310, while a second block leveling device 322, which includes a first guiding mechanism 324 and a second guiding mechanism 326, is mounted on the block 312 (see FIG. 5). A guide line 328 is attached to the block leveling devices 310, 312 such that the first guiding mechanisms 318, 324 cooperate to guide the guide line 328 in a generally horizontal direction along aligned upper edges 330, 332 of the blocks 310, 312, respectively (see FIG. 5). The remaining blocks 334 of the first course 314 are then laid between the blocks 310, 312 using the guide line 328 to facilitate their leveling (see FIG. 6). Without moving the block leveling device 316, 322, a guide line 336, which can be the guide line 328 or another guide line, is attached to the second guiding mechanisms 320, 326 such that the guide line 336 is guided in a generally horizontal direction at a preselected elevation (e) above the upper edges 330, 332 of the blocks 310, 312, respectively (see FIG. 6). Blocks 338 of a second course 340 are then laid between the block leveling devices 316, 322 using the guide line 336 to facilitate their leveling (see FIG. 7). The preselected elevation (e) is approximately equal to the height of the blocks 338 plus the thickness of the mortar between the first course 314 and the second course 340. Before laying end blocks 342, 344 for the second course 340, the block leveling devices 316, 322 are mounted on pre-leveled interior blocks 338', 338'', respectively, of the second course 340 in preparation for laying a third course 346 (see FIG. 8). After the third course 346 has been completed, the block leveling devices 316, 322 can be mounted on end blocks 348, 350, respectively, of the third course 346 in preparation for laying a fourth course 352 (see FIG. 9).

If two of the block leveling devices 10 are used to perform the above-described method, it is only necessary that one of them be equipped with the reel 92. Thus, the reel 92 can be omitted from the other one or simply not used.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

I claim:

1. A masonry block leveling device, comprising clamping means for releasably clamping said device to an upper surface of a single block, said clamping means including a base traversing the upper surface of the block, said base having a top surface, a bottom surface, a downwardly opening channel provided in said bottom surface and an elongated opening provided in said top surface and communicating with said channel, a first clamping member rigidly attached to one end of said base and extending downwardly therefrom adjacent to an outer side of the block, a slide slidable in said channel of said base between said one end of said base and an opposite end thereof, an externally threaded member attached to said slide and extending upwardly therefrom through said opening in said base, an internally threaded member threadedly received on said externally threaded member such that said internally threaded member can be tightened against said top surface of said base to lock said slide in place between said ends of said base, a second clamping member attached to said slide and extending downwardly therefrom adjacent to an inner side of the block, said second clamping member being movable conjointly with said slide to that the distance between said first and second clamping members can be adjusted to accommodate blocks having various different widths, and a lock bolt threadedly received in said second clamping member such that said lock bolt can be tightened to engage the inner side of the block; an upright rigidly attached to said one end of said base and extending upwardly therefrom such that said base and said upright form a right angle; a brace attached to said upright and to said opposite end of said base such that the right angle formed between said upright and said base is maintained; first guiding means for guiding a guideline in a generally horizontal direction along an upper edge of the block to facilitate the leveling of a first course of blocks, said first guiding means including an elongated groove formed in said first clamping member; and second guiding means for guiding a guideline in a generally horizontal direction at a first preselected elevation above the upper edge of the block to facilitate the leveling of a second course of blocks above the first course, said first preselected elevation being selected for blocks having a first height and said second guiding means including a slot formed in a lug extending outwardly from said upright, whereby said device facilitates the leveling of at least two courses of blocks without having to move said device and without having to construct lead corners.

2. A masonry block leveling device according to claim 1, wherein said base includes a level positioned so as to permit said base to be arranged in a horizontal plane.

3. A masonry block leveling device according to claim 1, further comprising third guiding means for guiding a guide line in a generally horizontal direction at a second preselected elevation above the upper edge of the block to facilitate the leveling of a second course of blocks above the first course, said second preselected elevation being selected for blocks having a second height which is less than said first height, whereby said second preselected elevation is lower than said first preselected elevation.

4. A masonry block leveling device according to claim 1, further comprising tensioning means for tensioning a guide line guided by said first guiding means or said second guiding means to inhibit sagging of the guide line.

5. A masonry block leveling device according to claim 4, wherein tensioning means includes a reel.

6. A masonry block leveling device, comprising clamping means for releasably clamping said device to an upper surface of a single block, said clamping means including an adjustable base traversing the upper surface of the block, said base including a first base member and a second base member movable linearally relative to said first base member such that the length of said base is adjustable, a first clamping member rigidly attached to an outer end of said first base member and extending downwardly therefrom adjacent to an outer side of the block, an upright rigidly attached to said outer end of said first base member and extending upwardly therefrom such that said base and said upright form a right angle, a second clamping member rigidly attached to an outer end of said second base member and extending downwardly therefrom adjacent to an inner side of the block, an externally threaded member attached to said second base member and extending through said upright, and an internally threaded member threadedly received on said externally threaded member such that said internally threaded member can be tightened against said upright to clamp said first clamping member against the outer side of the block and to clamp said second clamping member against the inner side of the block; first guiding means for guiding a guideline in a generally horizontal direction along an upper edge of the block to facilitate the leveling of a first course to blocks, said first guiding means including an elongated groove formed in said first clamping member; and second guiding means for guiding a guide line in a generally horizontal direction at a first preselected elevation above the upper edge of the block to facilitate the leveling of a second course of blocks above the first course, said first preselected elevation being selected for blocks having a first height and said second guiding means including a slot formed in said upright, whereby said device facilitates the leveling of at least two courses of blocks without having to move said device and without having to construct lead corners.

7. A masonry block leveling device according to claim 6, wherein said second clamping member is dimensioned so as to fit in a relatively small air space between the inner side of the block and an adjacent structure.

8. A masonry block leveling device according to claim 6, wherein one of said first and second base members includes a level positioned so as to permit said base to be arranged in a horizontal plane.

9. A masonry block leveling device according to claim 6, further comprising third guiding means for guiding a guide line in a generally horizontal direction at a second preselected elevation above the upper edge of the block to facilitate the leveling of a second course of blocks above the first course, said second preselected elevation being selected for blocks having a second height which is less than said first height, whereby said second preselected elevation is lower than said first preselected elevation.

10. A masonry block leveling device according to claim 9, further comprising fourth guiding means for guiding a guide line in a generally horizontal direction at a third preselected elevation above the upper edge of the block to facilitate the leveling of a second course of blocks above the first course, said third preselected elevation being selected for blocks having a third height which is less than said second height, whereby said third preselected elevation is lower than said second preselected elevation.

* * * * *